US007424942B2

(12) United States Patent
Voser

(10) Patent No.: US 7,424,942 B2
(45) Date of Patent: Sep. 16, 2008

(54) BANKNOTE HANDLING APPARATUS

(75) Inventor: Christian Voser, Satigny (CH)

(73) Assignee: MEI, Inc., West Chester, PA (US)

( * ) Notice: Subject to any disclaimer, the term of this patent is extended or adjusted under 35 U.S.C. 154(b) by 7 days.

(21) Appl. No.: 11/478,153

(22) Filed: Jun. 28, 2006

(65) Prior Publication Data

US 2007/0017775 A1 Jan. 25, 2007

(30) Foreign Application Priority Data

Jun. 29, 2005 (EP) ..... 05254073

(51) Int. Cl.
*G07F 7/04* (2006.01)
*B65H 7/02* (2006.01)
*B65H 7/06* (2006.01)

(52) U.S. Cl. ..... 194/206; 271/258.01

(58) Field of Classification Search ..... 194/206, 194/207

See application file for complete search history.

(56) References Cited

U.S. PATENT DOCUMENTS 4,381,447 A 4/1983 Horvath et al.
4,487,306 A * 12/1984 Nao et al. ..... 194/207
4,623,975 A 11/1986 Kagami
4,944,505 A 7/1990 Sherman, III
4,973,851 A 11/1990 Lee
5,443,257 A 8/1995 Sakamori
6,019,209 A * 2/2000 Hara et al. ..... 194/206

FOREIGN PATENT DOCUMENTS

EP 1 139 303 A2 10/2001
EP 1 295 825 A2 3/2003
WO WO 97/43734 11/1997
WO WO 98/00815 1/1998

* cited by examiner

*Primary Examiner*—Patrick Mackey
*Assistant Examiner*—Mark Beauchaine
(74) *Attorney, Agent, or Firm*—Fish & Richardson P.C.

(57) ABSTRACT

A first sensing means, which may form part of a banknote authenticator, is used to determine the profile of, for example, at least the leading edge of a banknote. Actuators located elsewhere in the banknote handling machine are operated in accordance with the outputs of other sensors, after taking the measured profile into consideration, so as to correct for errors due to the banknote being damaged in the area sensed by the other position detectors.

10 Claims, 3 Drawing Sheets

BANKNOTE HANDLING APPARATUS

BACKGROUND OF THE INVENTION

1. Field of the Invention

This invention relates to an apparatus for handling banknotes and/or other value documents such as cheques, coupons, etc., which are referred to herein collectively as "banknotes".

2. Description of Related Art

Banknote handling apparatuses are often required to perform a number of different operations on banknotes, for example causing them to be transported to various positions within the apparatus, measuring their characteristics, storing the banknotes and dispensing the banknotes. Reliable operation depends upon synchronising the operation of the various devices within the apparatus with the position of the banknote which is being handled.

Assuming that a banknote sensor is provided at a particular location in the apparatus, then is is possible, by using a timer, to determine when the banknote reaches further locations within the apparatus, based on the speed of operation of a transport mechanism. This however can be unreliable, because the speed of transport may differ from an expected speed, and may fluctuate.

In some arrangements, this problem is avoided by measuring the time using a clock synchronised to the operation of the transport mechanism (e.g. an encoder coupled to a motor shaft), instead of a fixed frequency clock. However, this arrangement can also be unreliable, for example if there is slippage between the banknote and the drive means (e.g. belts) of the transport mechanism.

To avoid these problems, multiple position detectors may be provided for sensing the banknote as it reaches each of a number of different locations within the apparatus. The position detectors may be optical or mechanical, for example. A substantial number of such detectors may be required, particularly if the apparatus has to perform many functions. In order to reduce the cost and complexity of the apparatus, each position detector is preferably a very simple device arranged to detect a part of the banknote when it reaches a particular position.

A problem encountered with such arrangements is that, if the banknote is torn or folded, or has holes or transparent windows, this could interfere with the operation of the position detector, which can then give a misleading output causing the banknote to be incorrectly handled, and possibly resulting in jamming of the apparatus. For example, banknotes travelling longitudinally along a path may be sensed using a position detector arranged to detect the presence of a banknote at a particular location across its width. However, if the leading edge of the banknote has a piece missing at this lateral location, then the leading edge of the banknote will have passed the location of the position sensor before the sensor output is generated. If it is intended to perform an operation on the banknote at a time dependent on the position sensor output signal, then this operation may start too late, leading to mishandling.

A solution to this problem would be to arrange for the position sensors to sense parts of the banknotes distributed across the entire width thereof. However, this solution would result in increased cost.

BRIEF SUMMARY OF THE INVENTION

Aspects of the invention are set out in the accompanying claims.

According to a further aspect of the invention, there is provided a first sensing means for sensing a banknote in a plurality of different areas thereof so as to determine the profile, or shape, of at least one edge of the banknote. Additional position sensors are provided. The output of each additional position sensor is used to trigger an operation which is performed upon the banknote. However, the time at which the operation is triggered is modified in accordance with the detected configuration of the banknote as sensed by the first sensor. Thus, if the first sensor detects an edge profile which will result in a premature or delayed output from the second sensor, then the output of the second sensor is corrected accordingly.

In this way, by providing a relatively sophisticated first sensor to detect the configuration of the banknote, it is possible to use further sensors of a simple nature while nevertheless avoiding the problems mentioned above.

Reliable authentication of banknotes often requires measurements to be performed at multiple areas of the banknote. Therefore, it is known to provide sensing means for performing these multiple measurements. A particularly preferred embodiment of the invention uses this same sensing means for detecting the banknote configuration, which is then used to correct the outputs of subsequent sensors. This enables the advantages of the invention to be provided with few, if any, additional components.

The first sensing means preferably uses optical techniques for detecting the different areas of the banknote. (References herein to optical sensors are intended to include those which operate using non-visible wavelengths, in addition to those that operate using visible wavelengths.) However, other means may be provided, such as mechanical or magnetic sensors.

The first sensing means may comprise a two-dimensional array of optical sensors for detecting respective different areas of the banknote. However, preferably, the first sensing means comprises a linear array of sensors which scan along respective lines of the banknote as the banknote is transported past the sensors.

Banknotes are usually transported in a direction which lies within the plane of the banknote and which is parallel to its length, or sometimes its width, dimension. The operations performed on the banknote are often timed to coincide with the leading, or sometimes trailing, edge of the banknote reaching a predetermined position. Sometimes the travelling direction of the banknote is reversed (that is, with respect to its orientation, such that the leading edge becomes the trailing edge, and vice versa). Accordingly, it is particularly preferred that the first sensing means is arranged to detect the profile of at least one of the trailing and leading edges of the banknote, and preferably at least the leading edge of the banknote, as it passes through the location of the first sensing means. It is conceivable that the direction of travel may change by some other angle, such as 90°, in which case it may be advantageous to detect the profile of a side edge (parallel to the direction of travel past the first sensing means).

BRIEF DESCRIPTION OF THE DRAWINGS

An embodiment of the invention will now be described by way of example with reference to the accompanying drawings, in which.

DETAILED DESCRIPTION OF THE INVENTION

Figure 1:
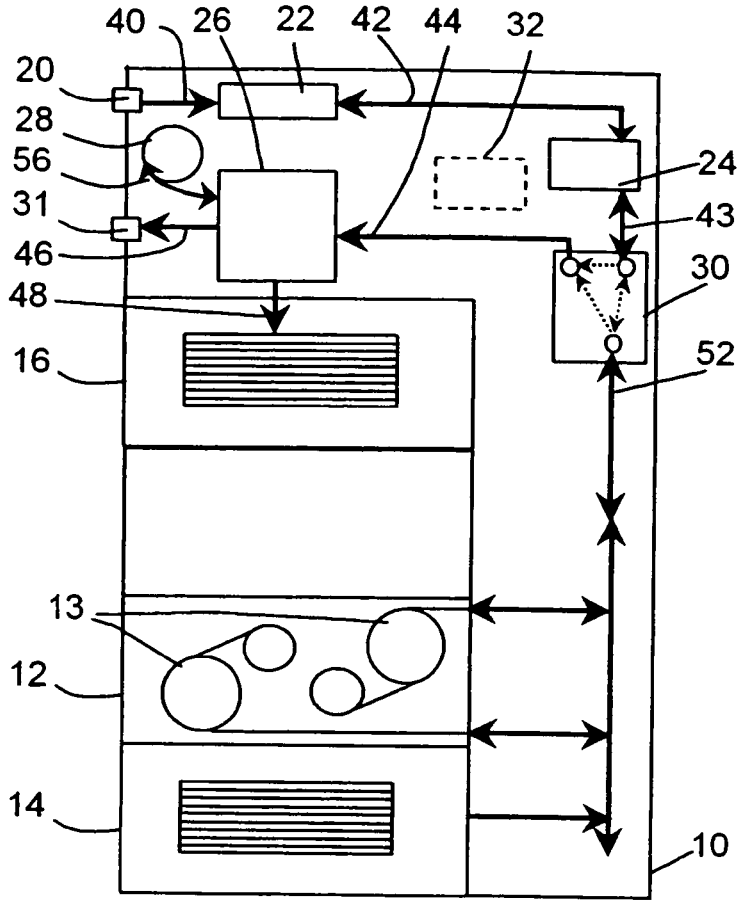
FIG. 1 is a schematic diagram of a banknote handler according to the invention.

FIG. 1 is a schematic diagram of a banknote handler 10 which includes a recycler module 12, a payout module 14 and a cashbox 16. Banknote handler 10 further includes a banknote inlet 20, a justifier 22, an authenticator 24, a temporary store 26, a bundler 28 and a banknote outlet 31.

The banknote handler 10 of the present embodiment is a banknote changer, which is operable to receive, test, store and dispense banknotes. The handler may be housed in a vending machine and used for payment for goods dispensed by the vending machine. Banknotes are received at inlet 20 and delivered via transport path 40 to the justifier 22. The justifier 22, which may operate as described in EP-A-1 321 403, is arranged to receive banknotes individually and align them such that they are delivered to a transport path 42 with their longitudinal direction aligned parallel to the transport direction, and with the banknote position laterally at a predetermined location.

The transport path 42 delivers the banknotes to the authenticator 24, which acts to authenticate and denominate banknotes passing therethrough. Such authenticators are well known in the art and the one used in the embodiment illustrated is of the type described in EP-A-1 321 904.

The banknotes from the authenticator 24 are delivered via transport path 43 to a gate 30. The gate can be controlled to route banknotes either to a main transport path 52 or to a discharge transport path 44. The gate can also be controlled to route banknotes from the main transport path 52 either to the discharge transport path 44 or to the transport path 43.

The main path 52 travels along a spine of the banknote handler 10 and conveys banknotes to and from individual modules, which in the illustrated embodiment comprise the recycler module 12 and the payout module 14.

The recycler module 12 is arranged to receive individual banknotes from the path 52 and to deliver banknotes individually to the path 52. The recycler module 12 includes one, or preferably more, individual recycle stores 13, each of which may be as described in, for example, EP-A-1 321 409. Each is arranged to store banknotes individually at successive locations along a spirally-wound support member. Each store normally contains banknotes of a single respective denomination.

The payout module 14 stores banknotes in a stack, and can deliver them individually to the main transport path 52.

Banknotes delivered from the modules to the main transport path 52 are conveyed by the transport path 52 to the gate 30, from which they can be delivered either to the discharge transport path 44 or to the transport path 43. The transport paths 42, 43 and 52 are bi-directional so that banknotes can be delivered from the justifier 22 via the authenticator 24 and the gate 30 to the modules, and can also be sent in the opposite direction from the modules to the justifier 22.

The discharge path 44 leads to the temporary store 26. Banknotes can be sent from the temporary store 26 to (i) the bundler 28 via a bi-directional path 56, (ii) a further transport path 46 leading to the banknote outlet 31, or (iii) the cashbox 16. The intention is that individual banknotes are either stored in the cashbox 16 or dispensed at outlet 31. If multiple banknotes are to be stored or dispensed, they are first collected on the bundler 28, and then returned as a stack to the temporary store 26, from which they are then sent either to the cashbox 16 or the outlet 31.

Although not shown in FIG. 1, the handler 10 may include additional modules, for example further payout modules and/or further recycler modules, all of which would be linked to the main transport path 52.

The operation of the handler 10 is controlled by a controller 32. The controller determines what action to take if a banknote fails or passes authentication and controls the operation of the banknote stores (the dispensing by, and receiving of, banknotes by the various banknote stores). The controller also controls the transport of banknotes between various locations of the handler 10 as well as the operation of the justifier 22, the authenticator 24 and the bundler 28.

During operation of the banknote handler, a user inserts a banknote into the inlet 20 and this is passed along path 40 to justifier 22 which can operate using any of a number of known techniques to ensure that the banknote has the correct orientation (with its leading edge substantially perpendicular to the direction of travel) before being passed on to authenticator 24 along path 42. The authenticator 24 determines whether the banknote is valid or not. If the banknote is not valid it is conveyed to temporary store 26 along discharge path 44. The banknote is then either returned to the user along path 46 leading to outlet 31 or, in an alternative mode of operation, directed to the cashbox 16 via path 48. In certain countries it is a legal requirement to retain forged banknotes.

If the banknotes received during a transaction are successfully authenticated, they are conveyed along path 52 and stored in a recycler 13 in the recycler module 12. It is to be realised that the controller maintains a record of the banknotes stored in, and dispensed from, recyclers 13. After the transaction, the temporarily stored banknotes are removed from their current location and sent to either the cashbox 16 or another recycler 13.

Banknotes can then be dispensed to users, from recycler and payout modules 12 and 14, as change. If desired, any banknote intended to be dispensed can first be routed to the justifier 22 and then to the authenticator 24 so that its authenticity and denomination can be verified.

A route person regularly visits the handler 10 and provides payout 14 which is preloaded with banknotes, and removes any empty or partially empty payouts. The payout 14 includes additional security features to ensure that the route person is not able to access the stored banknotes, but, once inserted, the banknotes are available to the handler 10.

The cashbox 16 is adapted to receive banknotes and does not dispense banknotes. When the cashbox is full, it is removed by a route person. The cashbox includes security features which ensure that the route person is not able to access the stored contents unless authorised e.g. by possession of a key.

Figure 2:
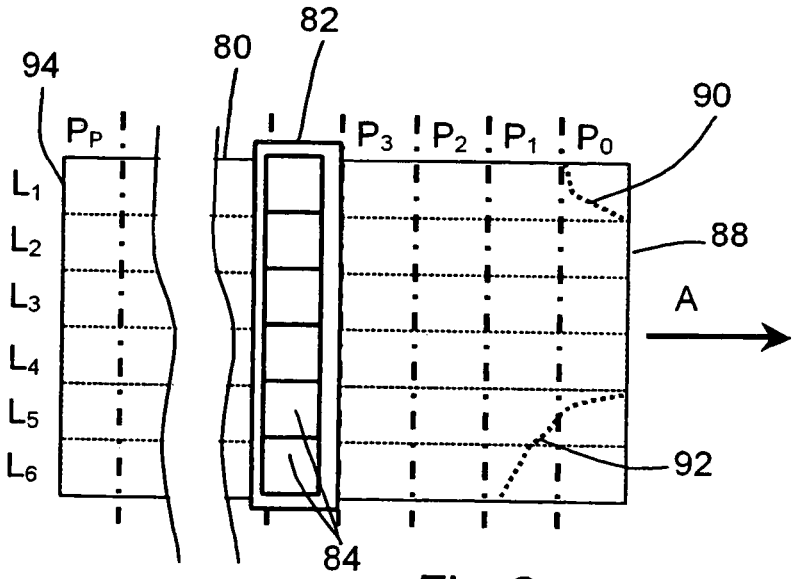
FIG. 2 illustrates the way in which a banknote is scanned by a first sensing means of the banknote handler.

FIG. 2 illustrates a banknote 80 as it passes through the authenticator 24, travelling in a direction A which lies within the plane of the banknote and is parallel to the longitudinal dimension of the banknote. A sensing means of the authenticator 24 is indicator schematically at 82. This is capable of sensing optical characteristics of the banknote in a number (at least six in the preferred embodiment) of regions 84 which are distributed along a direction which is transverse, and preferably perpendicular, to the scanning direction A. Accordingly, each banknote is scanned along six lines $L_1$ to $L_6$ as it is transported passed the sensing means 82.

Assuming the scanning means takes measurements at P* successive positions along the banknote as the banknote is transported passed the sensing means, then the characteristics of the banknote will be measured in P*×L* areas, where L* is the number of scanning lines. In the illustrated embodiment, the sensing means 82 is arranged to measure the optical transmissivity of the banknote in each of these P*×L* regions at a plurality of different wavelengths. In addition, reflectivity readings may also be taken on one or both opposed sides of the banknote in these areas, and, if desired, at a plurality of different wavelengths. The readings are commenced in response to the detection by the sensing means 82 of a significant decrease in transmissivity in any one or more of the regions being scanned, thus indicating the arrival of the leading edge 88 of the banknote.

Following this scanning operation, the controller 42 will store the measurements of the banknote. These will include a set of P*×L* data bits referred to herein as presence data each indicating whether the measurement in a respective area indicated the presence or absence of a banknote, based on the detected transmissivity in that area. In addition, for each of the P*×L* areas in which the presence of the banknote was detected, the controller will also store (a) a respective transmissivity measurement for each of a plurality of different wavelengths, (b) a respective first-side reflectivity measurement for each of a plurality of different wavelengths and, preferably, (c) a respective second-side reflectivity measurement for each of a plurality of different wavelengths. The transmissivity, first-side and second-side reflectivity measurements can be used for testing the banknote for authenticity and determining the banknote denomination, in ways that are known in themselves in the art.

The presence data is indicative of the shape of the banknote, and in particular the profiles of the edges of the banknote and of any holes or transparent windows in the banknote. As will be explained, this data is used so as to enable accurate position measurements using simple position detectors elsewhere in the apparatus. To facilitate this, the position data is preferably subjected to a pre-processing operation. A simple example of this will be presented.

Once the position data has been obtained, the software of the controller 32 instantiates a banknote shape object using the position data. The intention is that a separate shape object be instantiated for each banknote which is measured by the authenticator 24. Subsequently, when the position of the banknote is to be ascertained at a different location within the handler 10, the shape object is interrogated and the data retrieved therefrom is used to modify the output of a position detector.

It will be assumed for the purposes of explanation that each shape object will, upon instantiation, create an array representing the profile of the leading edge of the banknote. This array may comprise, for each scan line, an index value which represents the first of the P* scanning positions at which the presence of the banknote is detected in the respective scan line. For example, referring to FIG. 2, let it be assumed that the banknote 80 has torn or folded corners as indicated at 90 and 92. As a consequence, the banknote's presence will first be sensed in scan lines $L_2$, $L_3$ and $L_4$. Let it be assumed also that the scan position index is set to zero when the presence of the banknote is first detected. The leading edge will be detected in scan lines $L_1$ and $L_5$ at the next position, position P. The leading edge will be detected in scan line $L_6$ at the following position, position $P_2$. Therefore, the profile of the leading edge of the banknote can be represented by an array (1,0,0,0,1,2).

In a similar way, the shape object may derive and store the profile of the trailing edge 94 of the banknote. Also, further edge detecting processes may be used to store the profile of any intervening contiguous group of areas in which the presence of the banknote is not detected, i.e. any holes or transparent windows of the banknote.

After passing through the authenticator 24, the banknote needs to be handled by various other components of the handler 10, including the gate 30 and the components needed to route the banknote into the recycler module 12 and/or the temporary store 26 and/or the bundler 28 and/or the cashbox 16. Although the banknote is conveyed by transport devices which are moving at a controlled rate, it is nevertheless difficult to ascertain the precise position of the banknote, for example because of slippage of the banknote between belts of the transport mechanisms. For this reason, individual position sensors are located at various other positions throughout the handler 10.

Figure 3:
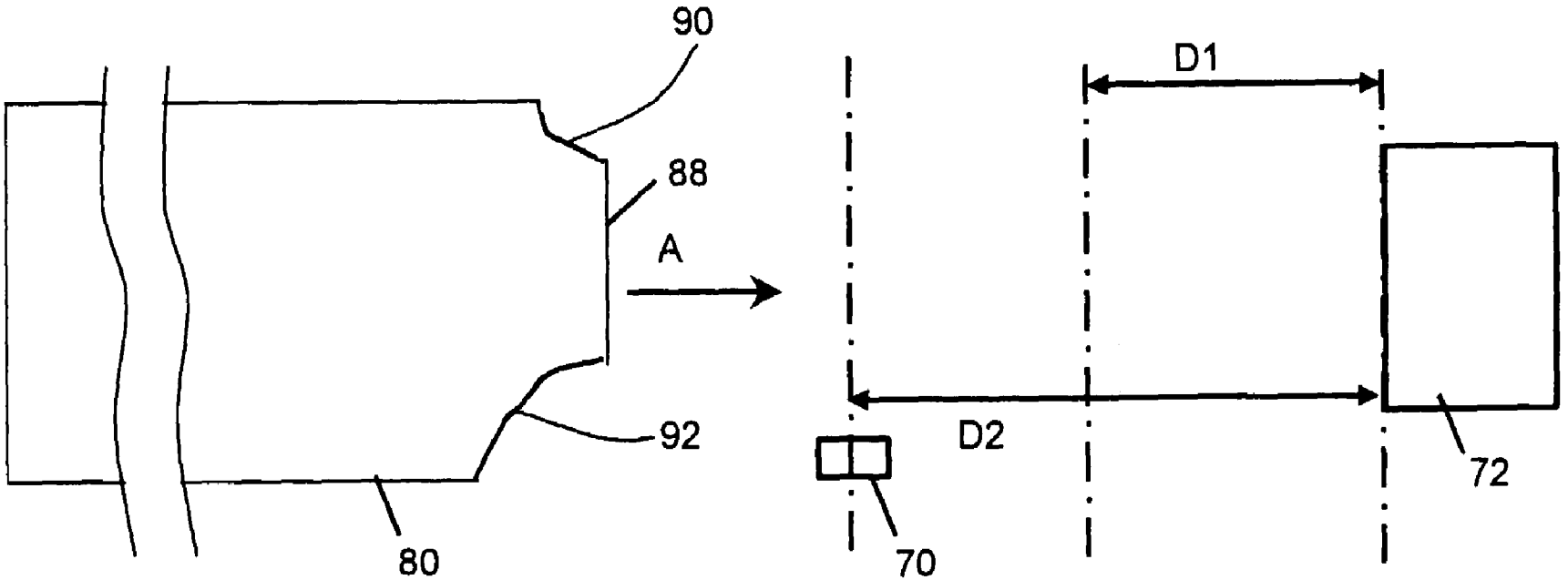
FIG. 3 diagrammatically shows a location within the handler containing a second sensing means of the handler.

FIG. 3 schematically represents one such position sensor 70 which in this case is an optical sensor arranged to sense the leading edge of the banknote 80 at a lateral position of the banknote which substantially corresponds to scan line $L_6$ in the authenticator 24. The position sensor 70 is located upstream (with respect to the transport path) of an actuator 72. The arrangement is such that, for proper operation, the actuator 72 should be operated when the leading edge 88 is positioned at a distance D1 upstream of the actuator 72. The sensor is located at a distance D2 upstream of the actuator 72. The transport device is arranged to move the banknote at a speed S in this region. Accordingly, the controller 32 should normally arrange to operate the actuator at a time t=(D1−D2)/S following a signal from the sensor 70 indicating the detection of the leading edge.

However, according to the present invention, the controller 32 performs the following operations:

(a) wait for a signal from the sensor 70;

(b) request the profile data from the shape object instance corresponding to the banknote 80;

(c) derive an offset value O from the profile data;

(d) calculate an adjusted time value using the formula $t^1$=(D1−D2−O)/S;

(e) waits for the adjusted time $t^1$ to elapse before operating the actuator A.

Step (b) results in the shape object sending the profile data in the form of the array, i.e. (1,0,0,0,1,2) in the example given above. Step (c) involves extracting from the array a value corresponding to the lateral position of the sensor. In this case, the position sensor 70 is located at a lateral position which substantially corresponds with scan line $L_6$ in the authenticator 24, and therefore the sixth element of the array, of value 2, is derived. The offset O is then obtained by multiplying the derived value, in this case 2, by a constant k representing the distance moved by the banknote 80 within the authenticator 24 between successive measurements by the first sensing means.

The actuator may be any of a number of different devices for controlling the movement of the banknote, including a further transport device arranged to transport the banknote to another part of the handler, a gate arranged to alter the routing of the banknote, etc. Alternatively, the actuator may control the transport device currently conveying the banknote, and be arranged to stop the motion at the calculated time.

Figure 4:
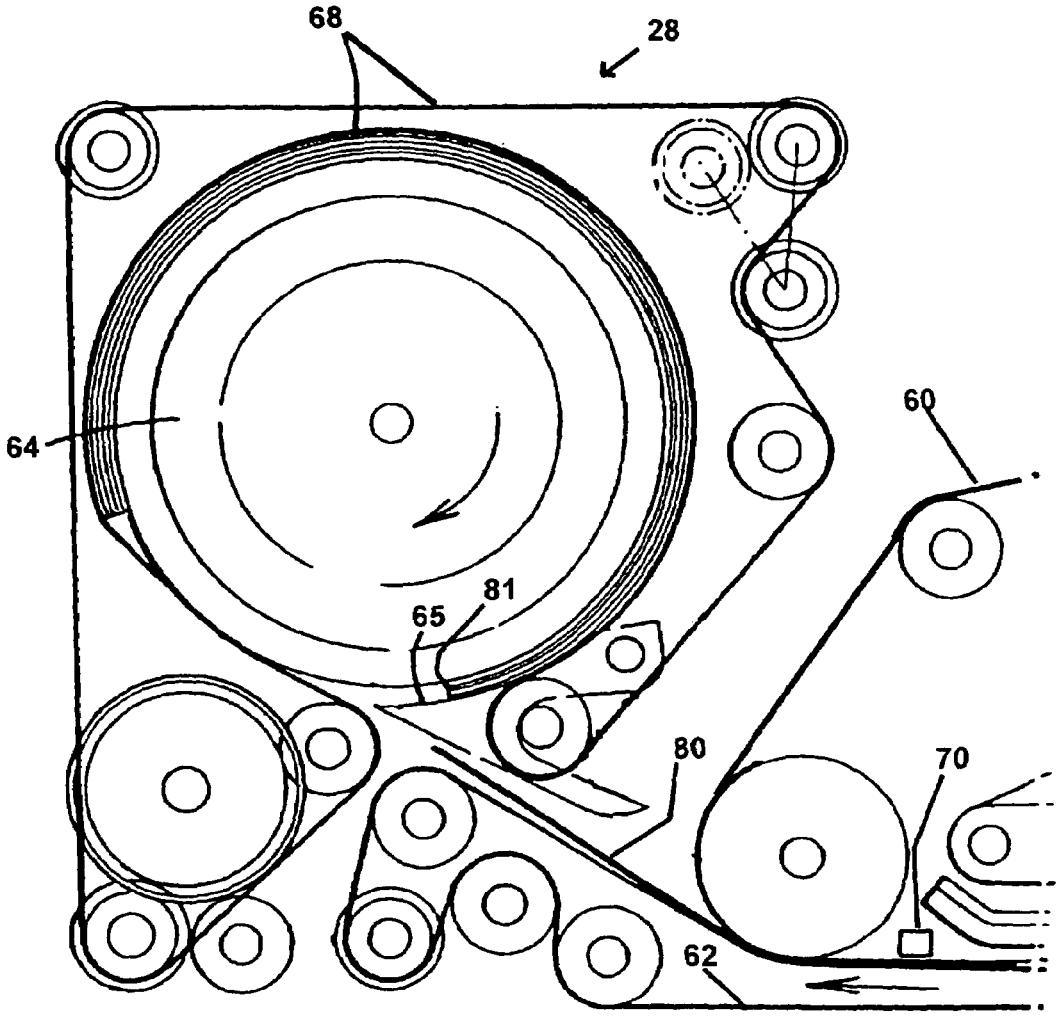
FIG. 4 illustrates a bundler of the banknote handler.

FIG. 4 shows an example of how the technique is used in conjunction with the bundler 28 of the banknote handler 10. Banknotes can be driven from the temporary store 26 to the bundler 28 using belts 60, 62. The bundler 28 includes a drum 64 which can be driven by a stepper motor (not shown) so that banknotes which are received in succession are successively stacked on top of each other and held on the drum by a belt 68. Accordingly, a bundle of banknotes is created on the drum. In order to remove the bundle and send it back to the temporary store 26, the directions in which the drum is rotated and in which the belts 60, 62 are driven are reversed, and a guide 65 is pivoted towards the axis of the drum so that the banknote bundle is stripped from the drum and fed between the belts 60, 62.

A position sensor 70 is arranged to detect the leading edge of a banknote as it is moved by the belts 60, 62 towards the drum. The controller 32 responds to the position detector 70 and commences the rotation of the drum at precisely the right time so that the leading edge of the newly-added banknote 80 is aligned with the leading edges 81 of the banknotes which are already stacked on the drum. Accordingly, a neat stack is formed.

Using the techniques of the present invention to modify the delay before actuation of the stepper motor means that these objectives can be accomplished even if the position sensor 70 gives an erroneous signal as a result of a damaged banknote.

The bundler may be used to bundle banknotes of different lengths. In some circumstances, it may be desirable to align the trailing edges of the banknotes stacked on the drum, rather than the leading edge. In that case, the arrangement described above may be modified so that the operation of the stepper motor to rotate the drum occurs in response to the position detector 70 sensing the trailing edge of the banknote, the timing then being modified in accordance with the profile of the trailing edge as stored by the shape object instance. Alternatively, the operation of the stepper motor could be initiated in response to detection of the leading edge by the position sensor 70, the timing then being modified in accordance with the stored profiles of both the leading and trailing edges.

In the embodiment described above, the first sensing means in the authenticator 24 is used to determine the profile of the leading edge throughout the entire width of the banknote. However, this may not be necessary, particularly if the other position sensors are confined to a limited number of lateral positions. For example, if all the other position sensors are located in a lateral position corresponding to only one of the scan lines, then it is merely necessary to determine the relative location of the leading edge in that region.

The presence data referred to above may be used additionally for authentication and/or denomination, for example by deriving a measurement of the banknote length and/or width. The data may also be used in assessing the condition of the banknote, and particularly whether it is suitable for dispensing as change, which will influence whether it will be directed to one of the recyclers 13.

In the arrangement described above, the timing of an operation performed on the banknote is based on the time that a sensing means detects the banknote in proximity to the location in which the operation is to be performed, the timing being adjusted according to the previously-detected profile of the banknote. The adjustment is determined in units of time, measured using a regular clock, based on the speed at which the banknote is moved, as calculated in distance units per time unit. Instead, the adjustment could be calculated in distance units, by using a clock which counts in response to movement of the transport means (e.g. using an encoder coupled to the transport means, as known in the prior art). This would account for slippage between the banknote and the transport belts; however, such accuracy is probably not necessary in view of the proximity of the sensing means to the location at which the banknote operation is to be performed.

The invention claimed is:

1. Apparatus for handling a banknote, the apparatus comprising:

first sensing means for sensing the banknote at a first location in the apparatus, the first sensing means being operable to detect the presence of the banknote at a plurality of positions so as to determine the profile of at least one edge of the banknote, at least one second sensing means for providing a detection signal in response to detecting the banknote when it passes through a respective further location in the apparatus, and at least one operation means arranged for performing an operation on the banknote at a timing determined by a combination of (a) the time at which said detection signal is provided, and (b) the profile of the edge as detected by the first sensing means.

2. Apparatus as claimed in claim 1, wherein the first sensing means is operable to scan the banknote as it passes through the first location so as to determine the profile of at least one of the edges of the banknote.

3. Apparatus as claimed in claim 2, wherein the first sensing means is operable to sense the banknote at a plurality of positions distributed along a direction transverse to the direction of travel so as to determine the profile of at least one of the leading and trailing edges of the banknote.

4. Apparatus as claimed in claim 3, wherein the first sensing means is operable to determine the profile of at least the trailing edge of the banknote, the apparatus further including means for reversing the direction of travel of the banknote so that the trailing edge reaches the operation means before the leading edge.

5. Apparatus as claimed in claim 1, including a said operation means in the form of an actuator for controlling the movement of the banknote.

6. Apparatus as claimed in claim 1, including a said operation means in the form of a transport device arranged to start transporting the banknote at said timing.

7. Apparatus as claimed in claim 1, including a said operation means in the form of a transport device arranged to stop transporting the banknote at said timing.

8. Apparatus as claimed in claim 1, including a said operation means in the form of a bundler arranged to cause the banknote to be added to a drum carrying a stack of banknotes at said timing.

9. Apparatus as claimed in claim 1, including a said operation means in the form of a gate arranged to alter a path along which the banknote is arranged to travel at said timing.

10. Apparatus as claimed in claim 1, including a validator device arranged to determine the authenticity of the banknote in accordance with signals from said first sensing means.

* * * * *